United States Patent [19]

Miyaguchi et al.

[11] 4,189,239

[45] Feb. 19, 1980

[54] APPARATUS TREATING SLUDGE DEPOSITS

[75] Inventors: Masao Miyaguchi; Tateo Kawamura, both of Tokyo; Kazuyoshi Nakanishi, Yokohamashi; Shoji Kohno, Chibashi, all of Japan

[73] Assignee: Takenaka Komuten Co., Ltd., Osaka, Japan

[21] Appl. No.: 856,788

[22] Filed: Dec. 2, 1977

[51] Int. Cl.[2] ..... B01F 7/18; B01F 15/02

[52] U.S. Cl. ..... 366/169; 366/346

[58] Field of Search ..... 366/345, 346, 155, 150, 366/169

[56] References Cited

U.S. PATENT DOCUMENTS

| | | | |
|---|---|---|---|
| 1,130,007 | 3/1915 | Nagle | 366/346 |
| 2,895,720 | 7/1959 | Koch | 366/345 |
| 3,425,671 | 2/1969 | Lely | 366/346 |
| 4,014,526 | 3/1977 | Cramer | 366/155 |

*Primary Examiner*—Robert W. Jenkins

[57] ABSTRACT

An apparatus for treating sludge deposits comprising a girder, first running means for moving the girder in a direction rectangular to the longitudinal direction of the girder, kneading means held on the girder, second running means for moving the kneading means through a holding frame in a direction rectangular to the longitudinal direction of the girder and lift means for bringing up and down the kneading means while a chemical is fed from the kneading means is disclosed.

5 Claims, 6 Drawing Figures

A

B

APPARATUS TREATING SLUDGE DEPOSITS

BACKGROUND OF THE INVENTION

The present invention relates to an apparatus for treating sludge deposits in which a sludge deposit layer in a broad region can be continuously and promptly treated.

With rapid progress of industries, sludge deposits have been accumulated in bottoms of harbors, rivers, lakes and the like, causing serious environmental pollutions. However, quantities of such sludge deposits have recently been increasing. Accordingly, development of an effective method or apparatus for treating these sludge deposits is eagerly desired in the art.

When sludge deposit is treated in situ according to the conventional method, there is ordinarily adopted a treating apparatus comprising kneading means including an agitation shaft having agitation blades attached to the lower portion thereof and being connected to a shaft of a driving member and chemical feeding means for extruding a chemical to a kneading zone of the kneading means. This treating apparatus is hung from a base ship on the sludge deposit to be treated or is hung by a moving type crane located on the ground in the vicinity of the sludge deposit layer, and the sludge deposit is agitated by the kneading zone while vertically moving the treating apparatus and is mixed with a coagulative chemical to treat a unit volume of the sludge deposit. When the treatment of this unit volume is completed, the treating apparatus is laterally moved and the above operation is similarly conducted. Thus, the sludge deposit layer is gradually treated by repeating the foregoing procedures.

As will be apparent from the foregoing illustration, a long time is required for treating the sludge deposit layer in a broad region according to the above conventional method. Further, according to this conventional method, it is difficult to harden the sludge deposit layer uniformly, and the treated layer often includes a portion inferior in the hardness and hence, utilization of the treated layer involves problems. Still further, when the treating apparatus is hung from a base ship, if the surface of the sludge deposit is not horizontal, it is difficult to treat the sludge deposit layer completely without leaving an untreated portion and the treatment is often incomplete. If the treatment is conducted so that no untreated portion is left, the treated portion is excessively lapped and treated, resulting in reduction of the treatment efficiency and failure to attain a uniform treatment effect.

OBJECTS OF THE INVENTION

It is a primary object of the present invention to provide an apparatus and method for treating sludge deposits, according to which a sludge deposit layer in a broad region can be treated promptly and uniformly.

Another object of the present invention is to provide an apparatus and method for treating sludge deposits, according to which means for kneading sludge deposit is always held in the vertical state even if the surface of the sludge deposit is not horizontal and the sludge deposit treatment can be performed without lapping of treated portions.

Still another object of the present invention is to provide an apparatus and method for treating sludge deposits, according to which means for kneading sludge deposit is arranged so that it can move in the two directions on a sludge deposit layer, whereby the treatment of sludge deposit in a band-like area can be performed assuredly with ease.

A further object of the present invention is to provide an apparatus and method for treating sludge deposits, according to which kneading means is laterally moved while it is vertically moved, so that a chemical can be sufficiently mixed and kneaded with sludge deposit.

A still further object of the present invention is to provide an apparatus and method for treating sludge deposits, according to which the quantity of the vertical movement of a kneading shaft is readily adjusted depending on the depth of a sludge deposit layer to be treated.

BRIEF DESCRIPTION OF THE DRAWING

FIG. 2-B is a side view illustrating another instance of kneading means.

DETAILED DESCRIPTION OF THE PREFERRED EMBODIMENTS

Figure 1:
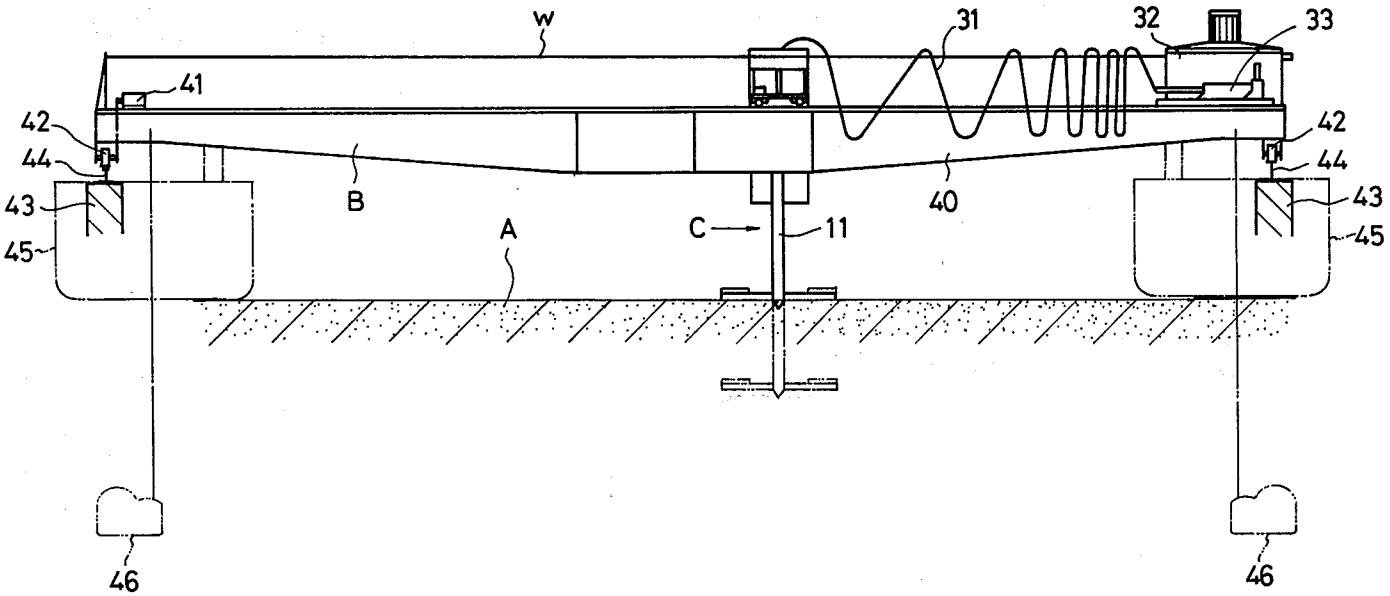
FIG. 1 is a front view illustrating the entire structure of the sludge deposit treating apparatus according to the present invention.
Figure 2:
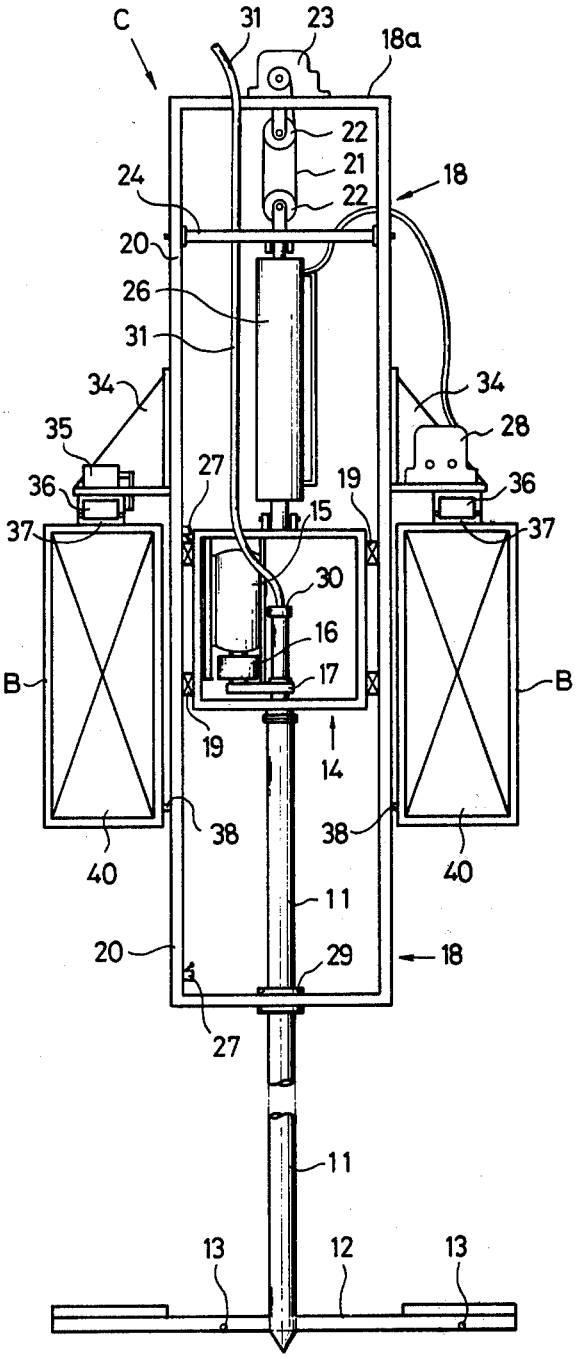
FIG. 2-A is a side view illustrating one instance of kneading means to be adapted to the treating apparatus shown in FIG. 1.
Figure 2:
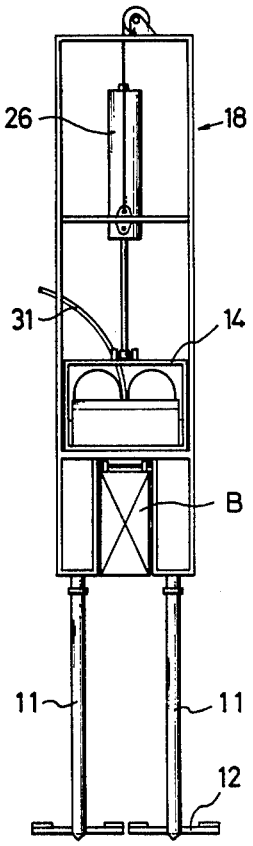

The apparatus for treating sludge deposit according to the present invention will now be described by reference to FIGS. 1 and 2 in the accompanying drawing.

The sludge deposit treating apparatus comprises a girder B capable of moving above and across a sludge deposit layer A and kneading means C held on the girder B movably in the longitudinal direction of the girder B.

The kneading means C is first described. Agitation blades 12 constituting a sludge deposit kneading zone are attached to the lower end of a sludge deposit kneading shaft 11. The kneading shaft 11 has a hollow structure and the hollow portion is used as a chemical passage as described hereinafter. A chemical extrusion opening 13 mounted on the agitation blade 12 is communicated with the hollow portion of the kneading shaft 11. The top end of the kneading shaft 11 is rotatably held on a moving frame 14 and this top end is rotated and driven by a motor 15 through a reduction gear device 16 and power transmission means 17. The motor 15 and the reduction gear device 16 are disposed on the moving frame 14. The moving frame 14 is vertically moved in a rectangular holding frame 18, and while the moving frame 14 is vertically moved, a guide member 19 such as a roller attached to the side portion of the moving frame 14 is guided by a longitudinal rod 20 or rail of the holding frame 18. A supporting plate 24 is vertically movably hung down from a ceiling portion 18*a* of the holding frame 18 through a wire 21, a sheave 22 and a winch 23, and a sliding portion is disposed between the supporting plate 24 and the longitudinal rod 20 of the holding frame 18 and is fixed to an appropriate part of the holding frame 18 through a pin or the like. The supporting plate 24 is connected to the moving frame 14 by a hydraulic cylinder 26 acting as means for vertically moving the kneading means, and the kneading shaft 11 is vertically moved through the moving frame 14 by repeated elongation and contraction of the hydraulic cylinder 26. Change-over of elongation and contraction is accomplished by controlling the change-over of a driving device 28 for elongation and contraction in the hydraulic cylinder 26 by depression of micro-switches disposed on the upper and lower portions of the holding frame 18 by the moving frame 14. The intermediate portion of the kneading shaft 11 is held rotatably and slidably in the axial direction by a receiving shaft 29 disposed on the bottom portion of the holding frame 18. The top end of the hollow portion of the kneading shaft is connected to a hose 31 through a swivel joint 30, and the other end of the hose 31 is communicated with a coagulating chemical store chamber 32 on the girder B through a compression feed device 33. The hose 31 is supported by a wire W laid out on the girder B so that it follows up with the movement of the kneading means C. The chemical store chamber 32 and compression feed device 33 may be located on the ground.

In order to hold the holding frame 18 on the girder B, brackets 34 are attached to both the side faces of the holding frame 18 and a pinion 36 rotated by a driving device 35 is mounted on each bracket 34. The pinion 36 is engaged with a rack 37 mounted on the girder B, and by rotation of the pinion 36, the kneading means C is moved in the longitudinal direction of the girder B. In this embodiment, roller means 38 attached to the side face of the lower portion of the holding frame 18 is rotated on the inner wall face of the girder B to hold the kneading means C in the perpendicular state. A wheel may be used instead of the rack and pinion and the kneading means C may be moved by pulling the girder B from both the ends by a winch.

The girder B will now be described. The girder B comprises a pair of long supporting beams 40 which are arranged so that the kneading means C can pass therethrough. In some modification, as shown in FIG. 2-B, only one supporting beam is disposed and kneading means C including two kneading shafts is mounted on this supporting beam so that the supporting beam is interposed between the kneading shaft. Wheels 42 rotated by a driving device 41 are disposed on both the ends of the girder B, and by rotation of the wheels 42 on a rail on a hard foundation base of the sludge deposit layer, the girder B is moved in a direction rectangular to the longitudinal direction thereof. In some modification, floats 45 may be disposed on both the ends of the girder B instead of the wheels 42 to set the sludge deposit treating apparatus afloat on the sludge deposit layer and the girder B may be moved by pulling the girder B through a wire by a winch 46 disposed on the ground.

The sludge deposit treating method of the present invention using the above-mentioned treating apparatus will now be described.

Figure 3:
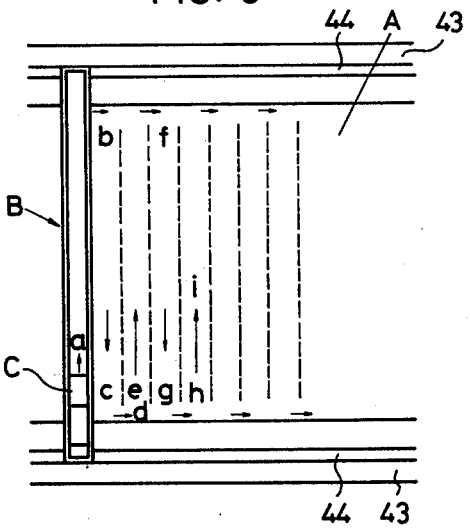
FIG. 3 is a front view of an entire treatment zone, which illustrates step procedures of treating sludge deposit.
Figure 4:
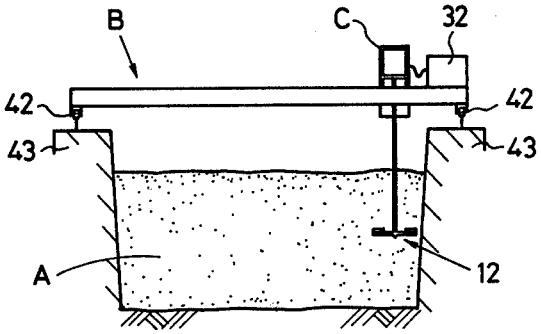
FIG. 4 is a sectional side view of the treatment zone shown in FIG. 3.

Referring now to FIGS. 3 and 4, an embodiment where a so-called band-like sludge deposit layer A having a rectangular shape, such as one accumulated on the bottom of a river or moat, is described. In general, banks are ordinarily constructed on both the shores of a river or moat. A rail 44 is laid out on each shore as the foundation base 43 in the longitudinal direction thereof, and the girder B of the sludge deposit treating apparatus is set to run on the rails 44 across the sludge deposit layer A. A chemical is compounded in a kneading plant disposed on the ground and supplied into the chemical store chamber 32 on the girder B. The chemical may be supplied directly to the kneading means C without being stored in the store chamber 32. The depth of the sludge deposit layer A is measured in advance, and the position of the supporting plate 24 is set by operating the winch 23 for determining the quantity of the vertical movement of the kneading shaft 11. The micro-switch 27 is disposed so that the uppermost limit position of the moving frame 14 is detected by the micro-switch 27, and the repeated vertical movement of the moving frame 14 is thus controlled.

The kneading means C of the so set sludge deposit treating apparatus is located on one end of the girder B in advance. Then, the motor 15 of the kneading means C is driven to rotate the kneading shaft 11 and agitation blades 12, and simultaneously, the driving device 28 for elongation and contraction is driven to initiate the elongation and contraction of the hydraulic cylinder 26 and continue the vertical movement. Further, simultaneously with the foregoing operations, the chemical is jetted from the extrusion opening 13 by the driving force of the compression feed device 33 and the pinion 36 is driven to move the girder B in the longitudinal direction thereof (in the direction indicated by an arrow a in the drawing). Thus, the kneading means C is laterally moved while the agitation blades 12 are vertically moved, and one band of the sludge deposit layer is kneaded and treated with the chemical. In this case, the vertical movement speed of the moving frame 14, namely the vertical movement speed of the agitation blades 12, is determined depending on the desirable hardening strength of the sludge deposit layer, and the moving speed of the kneading means C is variable and can be set at an appropriate level.

After one band of the sludge deposit layer has thus been treated, the lateral movement of the kneading means C is stopped. The wheels 42 are rotated by the driving device 41 to move the girder B along the rails 44 in a direction indicated by an arrow b, namely in the longitudinal direction of the sludge deposit layer, along a distance corresponding to the lateral dimension of the kneading means C and then, the girder B is stopped. When floats 45 are disposed on both the ends of the girder B, the girder B is moved in the longitudinal direction of the sludge deposit layer by means of the winch.

Then, in the same manner as described above, the continuous vertical movement of the agitation blades 12 and the lateral movement of the kneading means C are conducted to treat a subsequent band of the sludge deposit layer, and the movement of the girder B in the longitudinal direction of the sludge deposit layer is conducted again. In the same manner as described above, the treatment of the sludge deposit layer is carried out in the order of arrows c, d, e, f, g, h . . . in the drawing. The amount fed of the chemical is determined in advance according to the preliminarily examined properties of the sludge deposit to be treated, the desirable hardening strength, the vertical movement speed of the kneading means, the depth of the sludge deposit layer to be treated and other factors.

Figure 5:
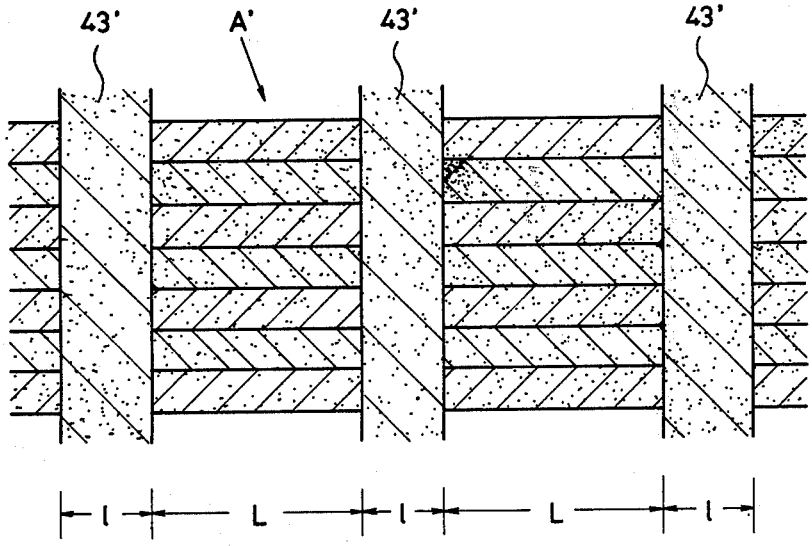
FIG. 5 is a view illustrating step procedures of the sludge deposit treatment according to another embodiment.

Another embodiment of the sludge deposit treatment method will now be described by reference to FIG. 5. According to this embodiment, a sludge deposit layer A′ in a broad region is treated by a treatment apparatus mounted on a base ship according to the known procedures. More specifically, bands having an appropriate width l and being parallel to one another at appropriate intervals L are subjected to the coagulating treatment to form foundation bases 43′, whereby the sludge deposit layer A′ in a broad region is divided into rectangular bands having long and short sides. The interval L is set so that the sludge deposit apparatus can be set along this interval L.

Rails are laid out on the foundation bases and the above-mentioned sludge deposit treating apparatus of the present invention is disposed on these rails across the sludge deposit layer in the same manner as described above in the first embodiment. Then, the agitation blades 12 are laterally moved while they are vertically moved as in the first embodiment, and the girder B is moved in a direction rectangular to the longitudinal direction of the sludge deposit layer, whereby the treatment is performed.

As will be apparent from the foregoing illustration, according to the present invention, since the agitation blades are laterally moved while they are continuously moved in the vertical direction, the entire of a sludge deposit layer in a broad region can be treated uniformly in preferred conditions. Further, since the girder can easily be moved also in the longitudinal direction of the girder, a sludge deposit layer in a broad region can be promptly treated uniformly. Moreover, the quantity of the vertical movement of the kneading shaft can easily be adjusted by controlling the position of the supporting plate.

What is claimed is:

1. A sludge deposit treating apparatus comprising a girder including first running means, which is arranged so that it can be moved above and across a sludge deposit layer along the longitudinal direction of the sludge deposit layer, a holding frame on said girder and including second running means moving in the longitudinal direction of said girder, said holding frame having longitudinal upper and lower beams; a moving frame disposed within said holding frame and being capable of being moved in the vertical direction between said longitudinal upper and lower beams of the holding frame through guide means, lift means disposed between said holding frame and moving frame to move the moving frame in the vertical direction repeatedly, a hollow kneading shaft having the upper end thereof rotatably held on the moving frame and the lower portion thereof rotatably and slidably held on the holding frame, agitation blades attached to the lower end of the kneading shaft, each agitation blade having an extrusion opening communicated with the hollow portion of the kneading shaft, a driving device mounted on the moving frame to rotate the kneading shaft, and chemical supply means communicated with the top end of the hollow portion of the kneading shaft.

2. A sludge deposit treating apparatus as set forth in claim 1 wherein said lift means includes micro-switches for detecting the upper limit and lower limit positions of the moving frame and a hydraulic cylinder for moving said moving frame between said limit positions, movement of said cylinder being controlled by the micro-switches through a change-over device for causing raising and lowering movements.

3. A sludge deposit treating apparatus as set forth in claim 2 wherein adjustment means is disposed between said lift means and the top end of the holding frame to change the position of the lift means.

4. A sludge deposit treating apparatus as set forth in claim 1 wherein the chemical supply means includes a chemical store chamber, a compression feed device for feeding out a chemical stored in said chemical store chamber and a hose member communicating said compression feed device with the hollow portion of the kneading shaft.

5. A sludge deposit treating apparatus as set forth in claim 1 wherein said first running means includes floats disposed on both the ends of the girder and a winch for pulling and moving the girder.

* * * * *